US008763552B2

(12) United States Patent
Holbrook

(10) Patent No.: US 8,763,552 B2
(45) Date of Patent: Jul. 1, 2014

(54) TENNIS SCORING APPARATUS

(76) Inventor: Stephen L. Holbrook, Salt Lake City, UT (US)

( * ) Notice: Subject to any disclaimer, the term of this patent is extended or adjusted under 35 U.S.C. 154(b) by 335 days.

(21) Appl. No.: 13/385,011

(22) Filed: Jan. 28, 2012

(65) Prior Publication Data

US 2013/0192515 A1 Aug. 1, 2013

(51) Int. Cl.
*A63B 71/06* (2006.01)

(52) U.S. Cl.
USPC ..... 116/223

(58) Field of Classification Search
CPC ..... A63B 49/00; A63B 71/06; A63B 71/62; A63F 1/18; A63F 2009/0035; G09F 11/00; G09F 11/06; G09F 11/08
USPC ..... 116/222, 223, 224, 225; 40/536, 40/606.01, 606.03, 606.14, 607.1, 617; D10/46.1
See application file for complete search history.

(56) References Cited

U.S. PATENT DOCUMENTS

| | | | | | |
|---|---|---|---|---|---|
| 3,220,127 | A | | 11/1965 | Wilson | |
| 3,515,092 | A | | 6/1970 | Stengel | |
| 3,922,805 | A | * | 12/1975 | Krug | 40/533 |
| 4,132,187 | A | * | 1/1979 | Moebius | 116/225 |
| 4,185,583 | A | * | 1/1980 | Stamm | 116/225 |
| 4,712,504 | A | | 12/1987 | Zarley et al. | |
| D300,435 | S | | 3/1989 | Harris et al. | |
| 4,831,956 | A | | 5/1989 | Thater | |
| 5,025,748 | A | | 6/1991 | Pettis | |
| 5,329,874 | A | | 7/1994 | Posey | |
| 5,385,113 | A | | 1/1995 | Hierath | |
| 5,615,636 | A | * | 4/1997 | Gustafson | 116/223 |
| D418,431 | S | | 1/2000 | Niksich | |
| 6,210,296 | B1 | * | 4/2001 | Gabriel | 473/464 |
| 6,234,918 | B1 | | 5/2001 | Nally et al. | |
| 6,578,513 | B1 | | 6/2003 | Niksich | |
| D615,423 | S | | 5/2010 | Alkire et al. | |
| D644,131 | S | * | 8/2011 | Karu | D10/46.1 |
| 8,578,875 | B1 | * | 11/2013 | Lee | 116/222 |
| 2013/0152849 | A1 | * | 6/2013 | Yang | 116/223 |

FOREIGN PATENT DOCUMENTS

| | | | | | |
|---|---|---|---|---|---|
| DE | 202005016705 | | * | 2/2006 | A63B 71/06 |
| FR | 2637508 | A1 | * | 4/1990 | A63B 69/38 |
| GB | 2110938 | A1 | * | 6/1983 | A63B 71/06 |
| JP | 09056866 | A | * | 3/1997 | A63B 71/06 |
| JP | 3163223 | U | * | 10/2010 | A63B 71/06 |

* cited by examiner

*Primary Examiner* — R. A. Smith
(74) *Attorney, Agent, or Firm* — Marcus G. Theodore

(57) ABSTRACT

An improved tennis scoring system using dual purpose flipping cards showing either game counts or alternatively tie break scores, which include a mounting bracket placeholder to maintain accurate positioning as the cards are flipped, an indicator showing when the dual purpose cards reflect tie breaker scoring, and coding indicating the players or doubles teams associated with the scores displayed by the flipping cards.

10 Claims, 3 Drawing Sheets

TENNIS SCORING APPARATUS

BACKGROUND OF THE INVENTION

1. Field

This invention pertains to tennis scoring systems. In particular, it pertains to an improved tennis scoring system using dual purpose flipping cards showing either game counts or alternatively tie break scores, which includes a mounting bracket with ring separator placeholder to maintain accurate positioning as the cards are flipped, an indicator showing when the dual purpose cards reflect tie break scoring, and coding indicating the players associated with the scores displayed by the flipping cards.

2. State of the Art

Various tennis scoring systems are known. Wilson, U.S. Pat. No. 3,220,127 issued Jun. 25, 1963 uses double rings to suspend flipping score cards and a player board, but does not include a card placement holder to prevent the cards from over rotating giving the wrong score. Posey, U.S. Pat. No. 5,329,874 issued Jul. 19, 1994 discloses a portable tennis score keeper with a plurality of score cards suspended from a single ring, which also fails to include a placement holder. Niksich, U.S. Des. Pat. No. D418, 431 issued Jan. 4, 2000 uses double rings to suspend flipping score cards with a different player board design than Wilson, but also fails to include a placement holder. Further, these card flipping systems only track the games won, and are not capable of tracking the points won in overtime matches.

Alkire et al, U.S. Des. Pat. No. D615, 423 issued May 11, 2010 is a score board post where the score is electronically displayed on a central post, and the player banners are suspended from a T bar.

Nally et al, U.S. Pat. No. 6,234,918 issued May 22, 2001 is a net scoring system using the bottom of a suspended net (volley ball, etc.) and its edges to keeping track of the game score.

Niksich, U.S. Pat. No. 6,578,513 issued Jun. 17, 2003 discloses a post with a plurality of scoring holes attached to a net post with 0 to 7 insertable tennis balls to display the tennis game scores. Hierath, U.S. Pat. No. 5,385,113 issued Jan. 31, 1996 discloses another tennis score keep and display device using insertable tennis balls on a net post to display the tennis score. Niksich and Hierath also do not track tie break scoring.

Harris et al., U.S. Des. Pat. No. D300, 435 issued Mar. 28, 1989 discloses an advertising scoreboard for tennis, including a player/advertising display board.

Pettis, U.S. Pat. No. 5,025,748 issued Jun. 25, 1991 discloses a portable scoring device with a ground penetrating tip and foot brace for driving and anchoring the post scoring section into the ground, which is primarily used to track scores at lawn events.

Stengel, U.S. Pat. No. 3,515,092 issued Apr. 23, 1969 discloses a tennis game set scoreboard with rolling disc displays.

Thater, U.S. Pat. No. 4,831,956 issued May 23, 1989 discloses a portable fabric tennis scoring device, which hangs from a tennis net post and is rolled up when not in use. Scoring is done with paddle shaped markers removably held in pockets in the fabric.

Zarley et al, U.S. Pat. No. 4,712,504 issued Dec. 15, 1987 is an example of various tennis racket scoring devices affixed to the racket.

These card scoring systems do not include a placeholder or an indicator showing that the cards can be used to reflect tiebreak play scoring. Without a placeholder, the cards can be incorrectly flipped requiring the scoring to be reconstructed from memory for the entire game. Conversely, applicant's scoring apparatus described below maintains the cards in position through the last recorded point, and in the event of a tiebreak, the flip cards can be used alternatively to track individual game points.

SUMMARY OF THE INVENTION

The invention comprises a tennis scoring apparatus, which tracks both tennis game standings and tiebreak scores using dual purpose flip cards. It comprises a T-shaped support bar with a horizontal segment having ring attachment structure adapted to support a plurality of circular rings and act as a card placeholder, and a support base structured as free standing or with securing means, such as adjustable straps structured to fit around and secure to one end of a net post via locking means, such as a lever locking band device, which tightens the straps to releaseably hold the base in position around an end of a net post. The base may be pivotally attached to the T-shaped support bar to allow the T-shaped support bar to pivot and turn to position a player's or team's flip cards in alignment with their position on the court.

A plurality of circular rings are affixed to the ring attachment structure that acts as a placeholder preventing the game and set cards from being improperly flipped out of order as is the case with free hanging rings.

Two bundles of ten game dual purpose flip cards are movably affixed to two of the circular rings to flip about the rings from one side of the T-shaped support bar to the other. These bundles of dual purpose flip cards are numbered zero through nine, with one bundle assigned to reflect the game scores of each player or doubles team. Tie breaks require the flip cards to be re-set and selectively flipped to reflect tiebreak scores of each tennis player or doubles team.

Two bundles of four set flip cards are movably affixed to two of the circular rings to flip about the rings from one side of the T-shaped support bar to the other. The set flip cards are numbered zero through three (or up to five for professional play), with one bundle assigned to reflect the score sets of each player, and selectively flipped to reflect the sets won by each tennis player or doubles team.

A tie break indicator is attached to the T-shaped support bar, which is activated at the start of tie break play, which notifies a viewing audience the tie break play has commenced. The dual purpose flip cards are then reset to zero and then used to reflect the tie break scores of each player or doubles team. In one embodiment, the tie break indicator has a top end and a base hingedly affixed to the middle of the top of the T-shaped support bar, which is structured to be vertically raised in one mode when there is tie break play. At the start of tie break play the dual purpose flip cards are re-set to zero and sequentially flipped to track each player's tiebreak score. During regular play, this tie break indicator is lowered.

As a super tie break frequently exceed 10 points, a second 10+ tie break indicator is included and activated and the dual flip cards again re-set to and sequentially flipped to track each player's or doubles team's tiebreak score from 10 to 19. In one embodiment, the top end of the raised tie break bar includes a ten point indicator bar with 10+ indicia hingedly attached to the tiebreak indicator. The ten point indicator bar is raised when tiebreak points more than 10 are in play so that the flip cards are re-set to zero and sequentially flipped to track each player's tiebreak score from 10 to 19. At scores below or above 10 to 19, the indicator bar is lowered.

Because tie break points sometimes exceed 20 points, a third 20+ tie break indicator is included and activated and the dual flip cards again re-set to zero and sequentially flipped to track each player's tiebreak score for 20 to 29. In one embodiment, the twenty point indicator bar with 20+ indicia is hingedly attached to the tiebreak indicator and raised when tiebreak points more than 20 are in play, at which time the ten point indicator bar is lowered and the flip cards are re-set to zero and sequentially flipped to track each player's tiebreak score from 20 to 29.

Additional tie break indicators may be included where scores exceed 30 following the same procedure. However, as this seldom occurs, the present tennis scoring apparatus only includes the 10+ and 20+ indicator bars. Thus the dual flip cards serve not only to track the game scores, but also tie break points, depending upon whether the tie break indicator bar is raised.

To accurately track player scoring, a "first server" game indicator is activated at the start of each set to indicate to a viewing audience if players are on serve. In one embodiment, two first server raiseable levers are hingedly affixed to ends of the top of the T-shaped support bar with one selectively raised at the beginning of a set to indicate which player started serving the set to enable observers to more accurately track the match score.

A sign board with player identification is affixed to the T-shaped vertical support bar beneath the dual flip cards to indicate, which flip cards reflect the game scoring of each respective player. Changeable identification sleeves may be affixed to the sign board to identify each player or doubles team. In one embodiment, tournament or league facilitators either hand write or print from a computer the players or doubles team name, and/or rating, district, sectional or national team name on heavy duty paper, which is then folded and affixed end to end to form a sleeve and then inserted onto the sign board during game and tie breaker play to identify players or doubles teams. The sleeve is then removed after play is complete.

The invention allows players to accurately keep and display the score in regular and tie break play by flipping a tie break indicator and using dual purpose cards that flip around a supporting T-shaped support bar with ring separator that acts as a starting placeholder and maintains accurate card order. The invention further eliminates score ambiguity during match play by flipping up one of two "first game server" indicators" to apprise viewers if the competing players are on serve.

The tennis scoring apparatus thus provides a combination total game and tie break scoring system and first service indicator to enable observers to track the progress of players during match play.

DESCRIPTION OF THE ILLUSTRATED EMBODIMENTS

Figure 1:
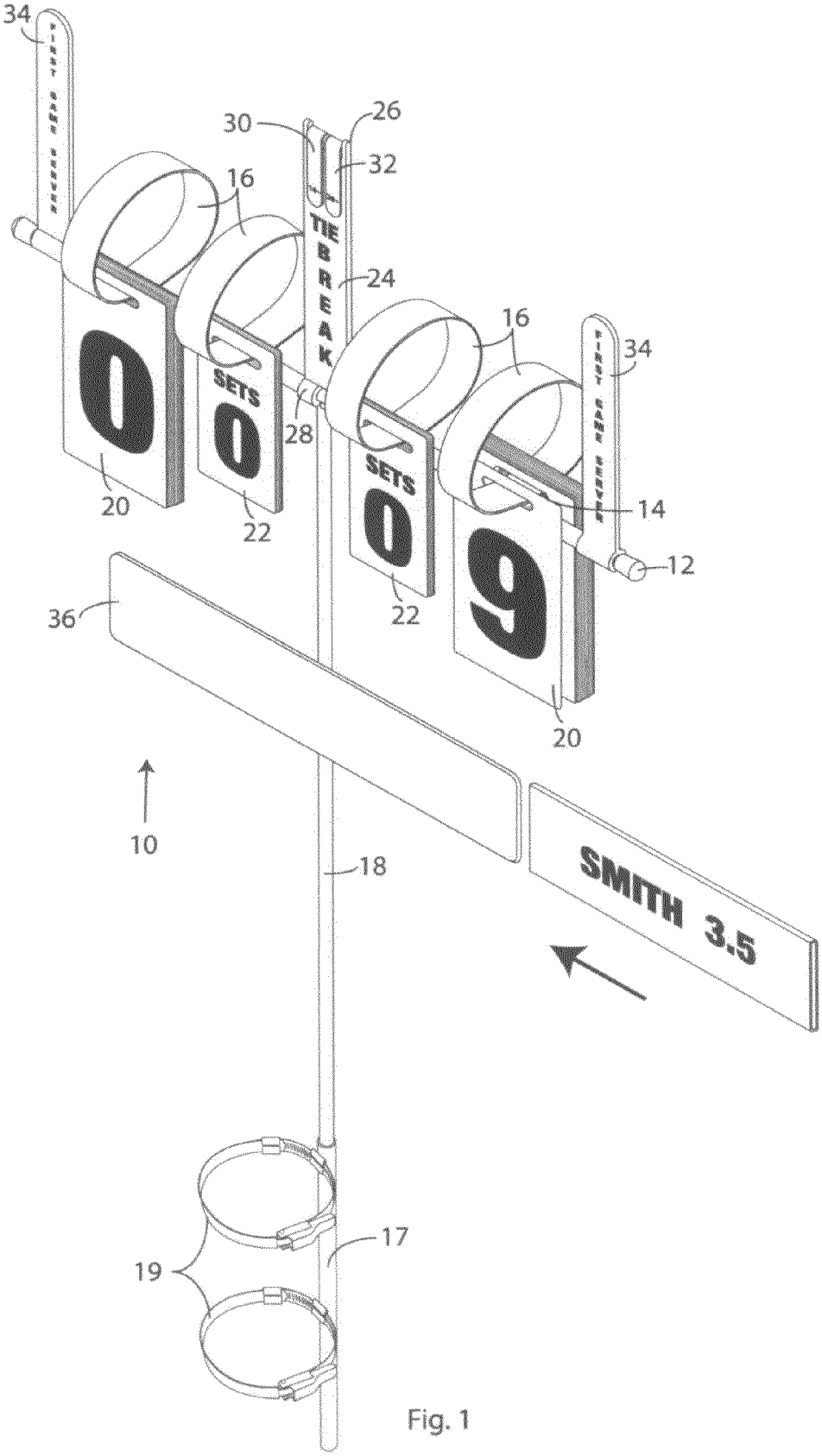
FIG. 1 is a perspective view of one embodiment of the invention.

FIG. 1 illustrates one embodiment of the tennis scoring apparatus 10, which comprises a T-shaped support bar 12 with a horizontal segment having ring attachment structure 14 adapted to support a plurality of circular rings 16, and a vertical segment 18 that inserts and rotates in a base 17 which is secured to one end of a net post with adjustable screw tightening straps 19.

Figure 2:
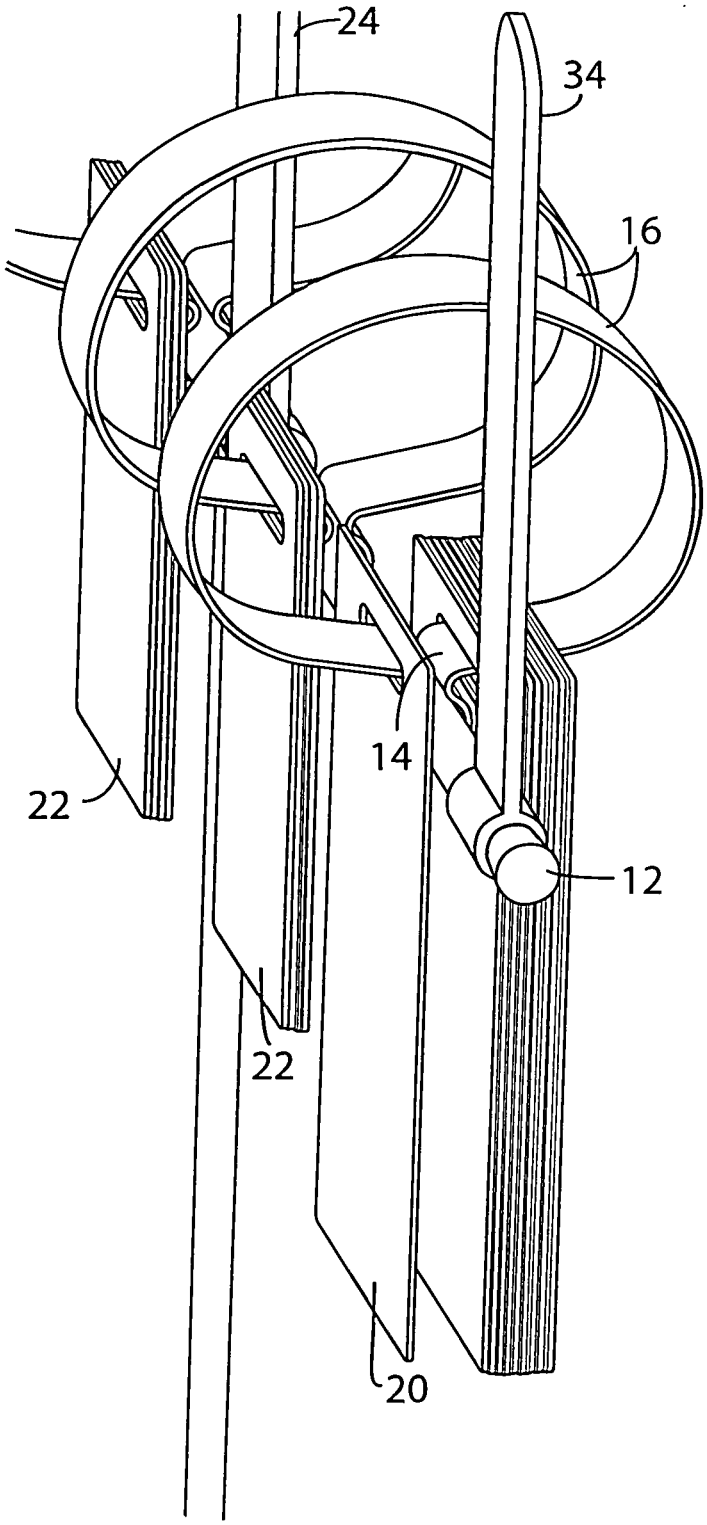
FIG. 2 is a rotated perspective view of the embodiment of FIG. 1

Four circular rings 16 are affixed to the ring attachment structure 14, which also acts as a placeholder as shown in FIG. 2 preventing the game and set flip cards 20, 22 from being improperly rotated.

Two bundles of ten game flip cards 20 are movably affixed to two of the circular rings 16 to flip about the rings 16 from one side of the T-shaped support bar 12 to the other. The game flip cards 20 are numbered zero through nine, and selectively flipped to reflect the game and/or tiebreak score of each tennis player or doubles team.

Two bundles of four set flip cards 22 are movably affixed to two of the circular rings 16 to flip about the rings from one side of the ring attachment structure 14 to the other. The set flip cards 22 are numbered zero through three, and selectively flipped to reflect the sets won by each tennis player or doubles team.

A tie break indicator bar 24 with a top end 26 and a base 28 is hingedly affixed to the middle of the T-shaped support bar 12 and structured to be vertically raised in one mode when there is tie break play. At the start of tie break play the game flip cards 20 are re-set to zero and sequentially flipped to track each player's tiebreak score. During regular play, the tie break indicator bar 24 is lowered.

As tie break points frequently exceed 10 points in super tie breaks, the top end of the raised tie breaker bar 24 includes a ten point indicator bar 30 with 10+ indicia hingedly attached to the tiebreak indicator 24. The ten point indicator bar 30 is raised when tiebreak points more than 10 are in play so that the flip cards are re-set to zero and sequentially flipped to track each player's or doubles team's tiebreak score from 10 to 19.

Because tie break points sometimes exceed 20 points, a second twenty point indicator 32 with 20+ indicia is hingedly attached to the tiebreak indicator 24 and raised when tiebreak points more than 20 are in play so that the ten point indicator bar 30 is lowered and the flip cards are re-set to zero and sequentially flipped to track each player's or doubles team's tiebreak score from 20 to 29.

Thus the game cards 20 serve not only to track the game score, but also the tie break points, depending upon whether the tie break indicator bar is raised.

To assist in accurately tracking a player's score, two first server raiseable levers 34 are hingedly affixed to ends of the top 14 of the T-shaped support bar 12 with one of which selectively raised at the beginning of each set to indicate to a viewing audience if the players or teams are on serve.

A sign board 36 with player identification is affixed to the vertical support bar 18 beneath the game flip cards 20 to indicate, which flip cards 20 reflect the game scoring of a respective player.

Figure 3:
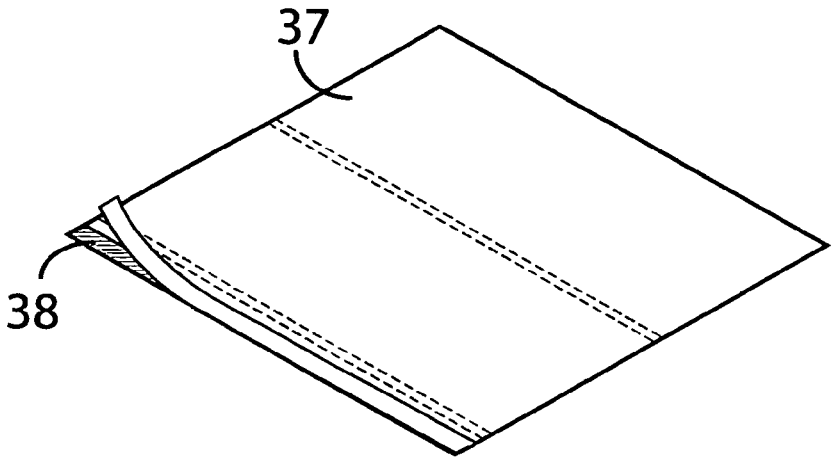
FIG. 3 is a perspective view of the interior of an identification sleeve.

FIG. 3 is a perspective view of the interior of a foldable identification sleeve 37. An adhesive strip 38 covered with removable paper backing is affixed along one interior edge of the sleeve 37. The sleeve 37 is folded and affixed end to end with the adhesive strip 38 along one edge of the interior of the sleeve 37 to form a sign 40, which is slipped on the sign board 36 before play.

Figure 4:
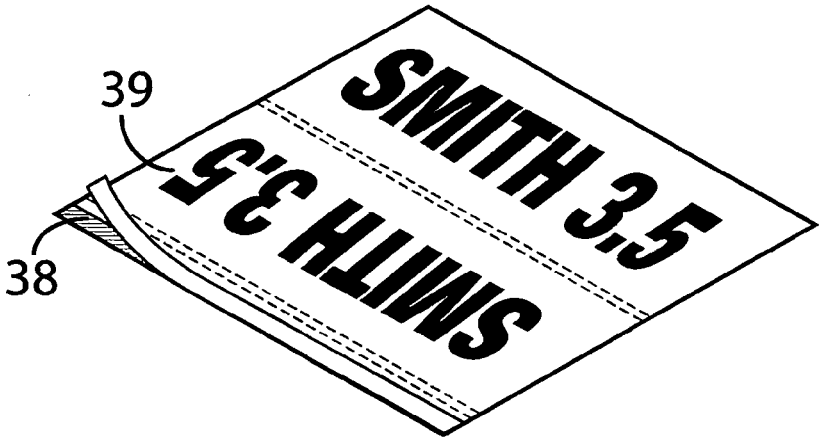
FIG. 4 is a perspective view of the exterior of the identification sleeve of FIG. 3.

FIG. 4 is a perspective view of the exterior of the identification sleeve 37 of FIG. 3. Tournament or league facilitators either hand write or print from a computer the players name, doubles team or district, sectional or national team name and rating to the exterior of the sleeve 37 so that when it is folded and affixed end to end, it forms the sign 40. Preferably, the sleeve 37 is made of heavy duty paper, which is scored to aid in folding end to end for securing into a sleeve by the adhesive strip 38

Figure 5:
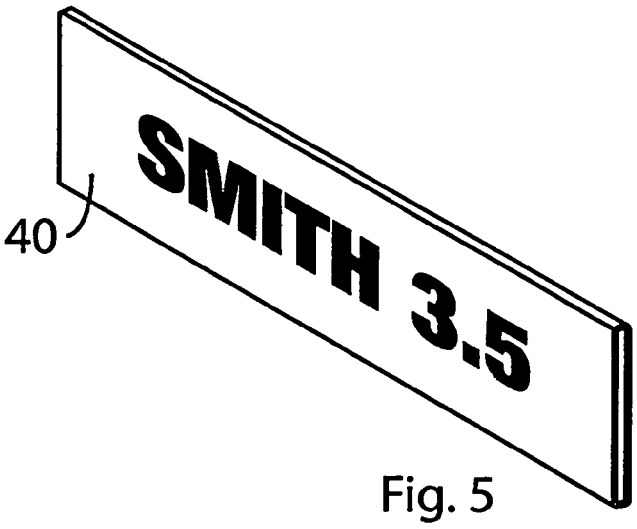
FIG. 5 is a perspective view of the folded identification sleeve of FIG. 3.

FIG. 5 is a perspective view of the folded identification sleeve 37 of FIG. 3 forming the removable sign 40.

The tennis scoring apparatus 10 thus provides a combination total game, tie break and "first server" scoring system to enable observers to track the progress of players during match play.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

I claim:

1. A tennis scoring apparatus comprising:

a. a T-shaped support bar with a horizontal segment having ring attachment structure adapted to support a plurality of circular rings and act as a card placeholder, and a vertical segment attached to a base adapted to affix to one of the end posts holding a tennis net or a support surface, b. at least four circular rings affixed to the ring attachment structure of the T-shaped support bar, c. two bundles of ten flip cards movably affixed to two or more of the circular rings that flip about the rings from one side of the ring attachment structure to the other such that the ring attachment structure acts as a placeholder to maintain the flip cards in flipped position until changed; said bundle of flip cards numbered zero through nine, and selectively flipped to reflect the game and/or tiebreak score of each tennis player or doubles team, d. two bundles of set flip cards movably affixed to two or more of the circular rings to flip about the rings from one side of the ring attachment structure and ring separator to the other such that the ring attachment structure acts as a placeholder to maintain the set flip cards in flipped position until changed, said sets of flip cards numbered one through three, and selectively flipped to reflect the sets won by each tennis player or doubles team, e. a tie break indicator hingedly affixed to the T-shaped support bar with a top end having two extra ten point indicators and structured to be vertically raised in one mode when there is tie break play and the flip cards are reset to zero at the start of a tiebreak and sequentially flipped to track each player's tiebreak score, and lowered in another mode when there is regular play;

the two extra ten point indicators comprising a first ten point indicator, which is activated when tiebreak points more than 10 are in play so that the flip cards are reset to zero and sequentially flipped to track each player's tiebreak score from 10 to 19; and a second twenty point indicator, which is activated when tiebreak points more than 20 are in play so that the flip cards are reset to zero and sequentially flipped to track each player's or doubles team's tiebreak score from 20 to 29; and f. at least one first server raiseable lever affixed to the top of the T-shaped support bar to be selectively raised at the start of each set to indicate which player or doubles team started serving first to enable viewing audiences to accurately track the match score by knowing if the competing players or doubles teams are on serve.

2. A tennis scoring apparatus according to claim 1, wherein the base is rotatably attached to the vertical segment of the T-shaped support bar to allow it to be turned to align the flip cards pointing to the player or doubles team associated with score shown on the flip cards.

3. A tennis scoring apparatus according to claim 1, wherein the tie break indicator is a bar with a top end hingedly attached to the middle of the T-shaped support bar, and including a ten point bar with indicia 10+ hingedly attached to the top of the tie break indicator, which is raised when tiebreak points from 10 to 20 are in play, and otherwise lowered; and a twenty point bar with 20+ indicia, hingedly attached to the top of the tie break indicator, which is raised when tiebreak points from 21 to 30 are in play, and otherwise lowered.

4. A tennis scoring apparatus according to claim 3, where the sign board is structured to accommodate changeable sleeves with play identification information indicating the respective player or doubles team associated with a set of flip cards.

5. A tennis scoring apparatus according to claim 1, including a sign board beneath the flip cards with player identification to indicate, which flip cards reflect the game scoring of a respective player or doubles team.

6. A tennis scoring apparatus according to claim 5, including an optional advertisement panel affixed to the T-shaped support upon which sponsors names may be placed.

7. A tennis scoring apparatus according to claim 1, wherein the base adapted to be secured to an end post comprises adjustable straps structured to fit around different shaped net posts, which are secured with a tightening device, which tightens the straps to releaseably hold them in position.

8. A tennis scoring apparatus comprising:

a. a T-shaped support bar with a horizontal segment having ring attachment structure adapted to support a plurality of circular rings and act as a card placeholder, and a base with adjustable straps structured to fit around and secure to one end of a net post, which are secured with a tightening device, which tightens the straps to releaseably hold the support bar in position.

b. four circular rings affixed to the ring attachment structure, c. two bundles of ten flip cards movably affixed to two of the circular rings to flip about the rings from one side of the ring attachment structure to the other such that the ring attachment structure acts as a placeholder to maintain the flip cards in flipped position until changed; said bundle of flip cards numbered zero through nine, and selectively flipped to reflect the game and/or tiebreak score of each tennis player or doubles team, d. two bundles of set flip cards movably affixed to two of the circular rings to flip about the rings from one side of the ring attachment structure to the other such that the ring attachment structure acts as a placeholder to maintain the set flip cards in flipped position until changed, said sets of flip cards number one through three, and selectively flipped to reflect the sets won by each tennis player or doubles team, e. a tie break indicator bar with a top end hingedly attached to the middle of the T-shaped support bar, which is raised when there is tie break play and lowered when there is regular play, and including:

1) a ten point bar with indicia 10+ hingedly attached to the top of the tie break indicator, which is raised when tiebreak points from 10 to 20 are in play so that the flip cards are returned to zero and sequentially flipped to track each player's tiebreak score from 10 to 19, and otherwise lowered; and 2) a twenty point bar with 20+ indicia, hingedly attached to the top of the tie break indicator, which is raised when tiebreak points from 21 to 30 are in play so that the flip cards are returned to zero and sequentially flipped to track each player's tiebreak score from 20 to 29, and otherwise lowered;

f. two first server raiseable levers affixed to ends of the top of the T-shaped support bar, one of which is selectively raised to indicate which player or doubles team started serving first at the beginning of each set to enable observers to more accurately track the match score by indicating to a viewing audience if players or doubles teams are on serve; and g. a sign board with player identification affixed to the vertical segment of the T-shaped support bar beneath the flip cards to indicate, which flip cards reflect the game scoring of a respective player or doubles team.

9. A tennis scoring apparatus according to claim 8, including an optional advertisement panel affixed to the T-shaped support bar upon which sponsors names may be placed.

10. A tennis scoring apparatus according to claim 8, wherein the base is rotatably attached to the vertical segment of the T-shaped support bar to allow it to be turned to align the flip cards pointing to the player or doubles team associated with score shown on the flip cards.

* * * * *